United States Patent [19]

Morrissey et al.

[11] Patent Number: 4,823,652

[45] Date of Patent: Apr. 25, 1989

[54] NUT GRABBER

[76] Inventors: William P. Morrissey, Rt. 1, Box 3, Green Pond, S.C. 29446; Christopher M. Horsley, 525 Recold Rd.; John A. Yurcho, Jr., Rt. 4, Box 386, both of Walterboro, S.C. 29488

[21] Appl. No.: 51,277

[22] Filed: May 18, 1987

[51] Int. Cl.[4] ..... B25B 13/02

[52] U.S. Cl. ..... 81/125

[58] Field of Search ..... 81/125, 119, 451, 55, 81/57.37, 176.1

[56] References Cited

U.S. PATENT DOCUMENTS

| | | | |
|---|---|---|---|
| 2,369,400 | 2/1945 | Malcolm | 81/125 |
| 2,659,258 | 11/1953 | Dillard | 81/125 |
| 2,953,049 | 9/1960 | Vilmerding | 81/125 |
| 2,985,049 | 5/1961 | Vilmerding | 81/125 |
| 3,416,395 | 12/1968 | Hanson | 81/125 |
| 3,447,405 | 6/1969 | Lennon | 81/119 |
| 3,668,952 | 6/1972 | Teutsch | 81/125 |
| 4,058,032 | 11/1977 | Jacks | 81/125 |

*Primary Examiner*—James G. Smith

[57] ABSTRACT

The NUT GRABBER provides through mechanical means, an open, box, or combination wrench which will retain the removed nut in the wrench after it is removed.

6 Claims, 1 Drawing Sheet

NUT GRABBER

BRIEF DESCRIPTION

The NUT GRABBER is an open, box end, or combination wrench which incorporates the use of spring loaded plungers to retain the nut in the wrench upon removal. The design facilitates adjustable pressure by which the user can adjust the amount of spring tension on the plunger which retains the nut.

DRAWING INTERPRETATION

FIG. 1 of the patent drawing depicts the relative size and location of the plunger assemblys in the standard wrench. The protrusion of the plunger into the throat of either the open or box end need only be approximately 1/32 of an inch. The location of the assemblys can be on either side of the open or box end.

FIG. 2 of the patent drawing shows a detail of the plunger assembly itself. It can easily be seen that the amount of pressure on the plunger can be adjusted by the amount that the setscrew is screwed into the drilled and threaded hole.

DETAILED DESCRIPTION

Figure 2:
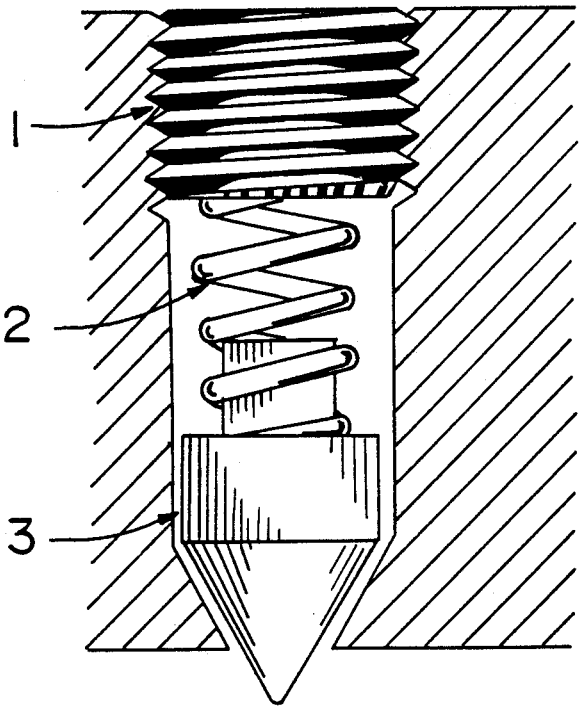
Figure 1:
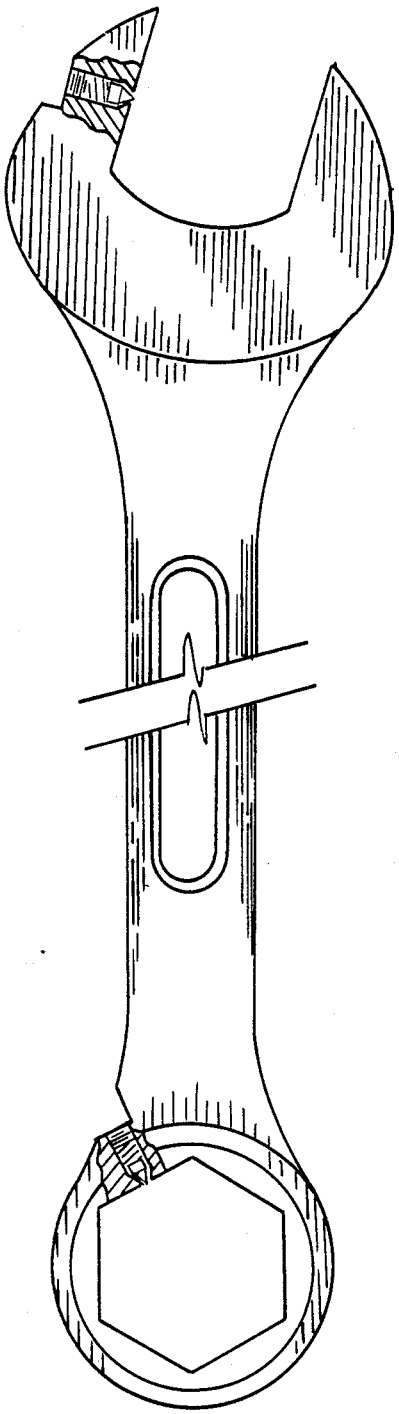

A standard open or box end wrench can be readily modified to become a NUT GRABBER by first spot-facing the desired location on either the box or open end of the wrench so that a hole approximately ⅓ of the wrench width placed perpendicularily will be located on to a flat area on the nut to be removed. The hole produced with a drill bit that has a 60 degree included point angle, protrudes into the throat of the open or box end of the wrench until the opening is approximately 1/32 of an inch in diameter. The hole is then counterbored approximately ⅓ of the total depth with the tap drill size of the next larger standard size thread to accommodate a set screw (item 1 of FIG. 2), and then threaded to that size.

A plunger made of hardened tool steel (item 3 of FIG. 2) with a major diameter approximately 0.010″ smaller than the inside diameter of the hole having a 60 degree included angle on the 1/64″ radius point and a shoulder on the top approximately 0.010″ smaller in diameter than the inside diameter of a suitable spring with the compressive strength similar to that of a ball point pen, (item 2 of FIG. 2), is placed into the hole.

The spring mentioned above is then placed into the hole and both pieces 2 and 3 are put under pressure by the set screw. The user than can set the tension of the spring to provide the desired holding power on the nut to be removed.

We claim:

1. An improvement in a wrench comprising; a bore in a side of said wrench, a plunger having first and second ends, said plunger first end tapering to a point to engage a nut to be held by said plunger, said plunger second end being a cylindrical portion of reduced diameter on which a spring is mounted, said spring surrounding said reduced diameter portion; a first end of said bore is tapered to receive said tapering first end of said plunger, and a second end of said bore is threaded to receive an externally threaded set screw, whereby the pressure said plunger exerts on said nut can be selectively varied.

2. The device of claim 1 wherein said wrench is an open ended wrench.

3. The device of claim 1 wherein said wrench is a box end wrench.

4. The device of claim 1 wherein said wrench is a combination wrench.

5. The device of claim 1 wherein said point on said tapering first end of said plunger is slightly rounded.

6. The device of claim 1 wherein a portion of said plunger between said first and second ends has a diameter which is within 0.010 inches smaller than a diameter of said bore located between said first and second bore ends.

* * * * *